US005246508A

United States Patent [19]

Grugal

[11] Patent Number: 5,246,508

[45] Date of Patent: Sep. 21, 1993

[54] UNIFORM COMPOSITE IN A HYPERMONOTECTIC ALLOY SYSTEM AND A METHOD FOR PRODUCING THE SAME

[75] Inventor: Richard N. Grugal, Nashville, Tenn.

[73] Assignee: Vanderbilt University, Nashville, Tenn.

[21] Appl. No.: 710,357

[22] Filed: May 31, 1991

[51] Int. Cl.[5] ..... C22C 1/09

[52] U.S. Cl. ..... 148/404; 420/590; 428/288; 428/379

[58] Field of Search ..... 148/404; 420/590; 428/614, 288, 379

[56] References Cited

U.S. PATENT DOCUMENTS

| | | | |
|---|---|---|---|
| 4,198,232 | 4/1980 | Parr et al. | 148/404 |
| 4,462,454 | 7/1984 | Hellawell | 164/133 |
| 4,891,059 | 1/1990 | Diamond et al. | 420/590 |

OTHER PUBLICATIONS

Grugel and Hellawell, "Alloy Solidification in Systems Containing a Liquid Miscibility Gap", Metall. Trans. A 1982 vol. 12A pp. 669–681.

Carlberg and Fredriksson, "The Influence of Microgravity on the Solidification of Zn-Bi Immiscible Alloys", Metall. Trans. A., vol. 11A, 1980, pp. 1665–1676.

Grugel et al., "Directional Solidification of Alloys in Systems Containing a Liquid miscibility Gap", Mat. Res. Soc. Symp. Proc. Elseveir Pub. Co., New York, N.Y. 1982, pp. 553–561.

Potard, "Structures of Immiscible Al-In Alloys Solidified Under Microgravity Conditions", Acta Astronautica, 9, No. 4, 1982, pp. 245–254.

Jackson et al., "Lamellar End Rod Eutectic Growth", Trans. Met. Soc. AIME, vol. 236, 1966, pp. 1129–1142.

Sample et al., "The Mechanisms of Formation and Prevention of Channel Segregation During Alloy Solidification", Metall. Trans. A, vol. 15A, 1984, pp. 2163–2173.

Grugel and Poorman, "Hypermonotectic Alloy Solidification in a Microgravity Environment", Mat. Science Forum, vol. 50, 1989, Trans. Tech. Pub., Switzerland, pp. 89–100 ISSN 0255-5476.

Mortensen et al., "On the Infiltration of Metal Matrix Composites", Met. Trans. A, vol. 18, 1987, pp. 1160–1163.

Yurek et al., "Superconducting Microcomposites by Oxidation of Metallic Precursors", Jour. of Metals, Jan. 1988, pp. 16–18.

Grugel and Hellawell, "The Breakdown of Fibrous Structures in Directionally Grown Monotectic Alloys", Metall. Trans A, vol. 15A, 1984, pp. 1626–1631.

*Primary Examiner*—George Wyszomierski

[57] ABSTRACT

A uniform composite of hypermonotectic composition and a method for producing the same wherein the composition has a plurality of aligned and constrained fibers therein. These fibers serve to uniformly distribute $L_{II}$ from the reaction $L_I \rightarrow S_I + L_{II}$.

16 Claims, 16 Drawing Sheets

Succinonitrile-10wt. pct Glycerine
Growth Velocity = 0.6μm/s
Temperature Gradient = 45K/cm
Enamel-Coated Copper Fibers Succinonitrile-10wt. pct Glycerine
Growth Velocity = 1.0μm/s
Temperature Gradient = 39.3K/cm
Teflon Fibers 250μm 1mm Succinonitrile-10wt. pct Glycerine
Growth Velocity = 6.0μm/s
Temperature Gradient = 42.5K/cm
Enamel-Coated Copper Fibers 250μm Succinonitrile-10wt. pct Glycerine
Growth Velocity = 0.1μm/s
Temperature Gradient = 55.5K/cm
Kanthal Fibers 250μm Succinonitrile-26 wt.pct. Ethanol
Growth Velocity = 0.6 μm/s
Temperature Gradient = 54.6 K/cm
Glass Fibers Succinonitrile-26wt. pct Ethanol
Growth Velocity = 6.0μm/s
Temperature Gradient = 27.8K/cm
Teflon Fibers 250μm Succinonitrile-26wt. pct Ethanol
Growth Velocity = 0.1μm/s
Temperature Gradient ≈ 30K/cm
Teflon Fibers

UNIFORM COMPOSITE IN A HYPERMONOTECTIC ALLOY SYSTEM AND A METHOD FOR PRODUCING THE SAME

ORIGIN OF THE INVENTION

This invention was made under a contract of the National Aeronautics and Space Administration, NAGW-810, NASA Code C. The assignee claims rights under this invention pursuant to 35 U.S.C. §201 et. seq. including 35 U.S.C. §202.

BACKGROUND OF THE INVENTION

The invention pertains to a uniform composite in a hypermonotectic alloy system and a method of producing the same. More specifically, the invention pertains to a uniform composite in a hypermonotectic alloy system and a method for producing the same wherein a plurality of constrained fibers, aligned paralled to the direction of growth, are used to provide for the directional solidification of $L_{II}$ phase.

Alloys of hypermonotectic composition are used and have been suggested for application as bearing materials, free machining materials, electrical materials, electrical contacts, glasses and superconductors. Therefore, these alloys have useful applications.

The solidification of hypermonotectic alloys involves passing through a miscibility gap, which is a characteristic of a hypermonotectic alloy. In this gap, two liquids, often of very different composition and density, co-exist in the liquid state. This density difference promotes rapid phase separation, and hence, massive segregation upon solidification. Massive segregation is an undesirable result because it leads to inferior material properties.

Others have postulated that sedimentation could be eliminated by processing these alloys in a microgravity environment so as to achieve a uniform composite structure. Although the microgravity concept generated considerable interest, it was found that processing in the microgravity environment still produced massively segregated structures. A number of explanations for these results have been proposed that include phase diagram inaccuracy, insufficient mixing, residual or induced convection, thermal gradient effects, droplet coalescence, and preferential wetting of the container by one of the liquid phases.

One aim of the present invention is to eliminate phase diagram inaccuracy, insufficient mixing, residual and induced convection, thermal gradient effects as limiting factors. Another aim is to use droplet coalescence, and preferential wetting of the container by one of the liquid phases to help achieve a uniform structure without macrosegregation.

The binary miscibility gap systems of interest are characterized by a region where two distinctly different liquids are in thermodynamic equilibrium, and the presence of the monotectic reaction, $L_1 = S_I + L_{II}$. Though similar in form to the well studied eutectic, two possibilities exist at the monotectic reaction. These possibilities are that $L_{II}$ can either wet or not wet $S_1$.

In the first case where $L_{II}$ wets $S_I$, and when employing controlled directional solidification techniques, the microstructure of the former case exhibits a uniform, hexagonal close-packed array of aligned $L_{II}$ fibers. In the second case when $L_{II}$ does not wet SI, and when using controlled directional solidification techniques, $L_{II}$ droplets collecting at the interface are pushed and eventually physically incorporated, leading to a somewhat irregular structure. This has been theoretically discussed by Chadwick (G. A. Chadwick, *Brit.J.Appl.-Phys.*, 1965, Vol. 16, pp. 1095–1097) and Cahn [J. W. Cahn, *Metall.Trans.A.*, 1970, Vol. 10A, pp. 119–121]and experimentally verified by Livingston and Cline (J. D. Livingston and H. E. Cline, *Trans.TMS-AIME*, 1969, Vol. 245, pp. 351–357) and Grugel and Hellawell (R. N. Grugel and A. Hellawell, *Metall.Trans.A.*, 1982, Vol. 12A, pp. 669–681). Furthermore, the transition from wetting to non-wetting has been shown to change abruptly through the selected addition of a ternary component, both in organic [M. R. Moldover and J. W. Cahn, Science, 1980, Vol. 207, pp. 1075–1076; and R. N. Grugel and A. Hellawell, *Materials Research Soc. Proc.*, Elsevier Science Publishing Co., Inc., 1982, Vol. 19, pp. 417–422) and metal (R. N. Grugel and A. Hellawell, *Metall.Trans.A.*. 1982, Vol. 12A, pp. 669–681) systems.

Uniform solidification of hypermonotectic alloys has been hampered by the inherent, usually large, density differences between the $L_I$ and $L_{II}$ phases. This leads to rapid separation, coalescence and, consequently, a highly inhomogeneous structure. Although some inhomogeneity can be minimized by employing rapid solidification techniques (S. N. Tewari, *J. Mat. Sci.*, 1989, Vol. 8, pp. 1098–1100. J. L. Reger, *Proc. 3rd Space Processing Symposium Skylab Results:* Vol. 1, *NASA Report M*-74-5, 1974, pp. 133–158), there is a great need to be able to produce a uniform composite in a hypermonotectic alloy system.

SUMMARY OF THE INVENTION

It is a principal object of the invention to provide an improved uniform composite in a hypermonotectic alloy system and a method for producing the same.

It is another object of the invention to provide an improved uniform composite in a hypermonotectic alloy system and a method for producing the same that uses controlled directional solidification techniques so as to provide an aligned uniform composite.

It is another object of the invention to provide an improved uniform composite in a hypermonotectic alloy system and a method for producing the same that incorporates constrained fibers, aligned in a direction parallel to the growth direction, to uniformly distribute the $L_{II}$.

In one form thereof, the invention is a uniformly aligned composite produced by the process comprising the following steps. A step of providing a cell having a plurality of generally parallel fibers contained therein. A step of then mixing together two liquids of different compositions wherein said liquids have different densities and compositions. Another step of placing the liquid mixture within the cell. Next, the step of providing a temperature gradient for the cell for directional solidification so that for a hypermonotectic composition of the liquid mixture, which presents the reaction $L_I \rightarrow S_I + L_{II}$, the $L_{II}$ will precipitate out of the $L_I$ and coalesce along the fibers as the mixture translates to a lower temperature.

In another form thereof, the invention is a composite having uniformly aligned regions therein wherein the composite is formed from a hypermonotectic composition which presents the reaction $L_I \rightarrow S_I + L_{II}$ upon initial cooling and the reaction $L_{II} \rightarrow S_{II}$ upon further cooling. The composite comprises a matrix comprised of $S_I$;

a plurality of generally parallel fibers; and a relatively uniform thickness of $S_{II}$ on the fibers.

In still another form thereof, the invention is a process for the production of an alloy composite comprising the following steps. A step of providing a cell having a plurality of generally parallel fibers contained therein. The step of mixing together two liquids of different compositions wherein said liquids have different densities and compositions. A step of placing the liquid mixture within the cell. A step of providing a temperature gradient for the cell for directional solidification so that for a hypermonotectic composition, which presents the reaction $L_I \rightarrow S_I + L_{II}$, the $L_{II}$ will precipitate out of the $L_I$ and coalesce along the fibers as the mixture translates to a lower temperature.

BRIEF DESCRIPTION OF THE DRAWINGS

The drawings which accompany and form a part of this application are briefly described below.

DETAILED DESCRIPTION OF SPECIFIC EMBODIMENTS

Figure 1:
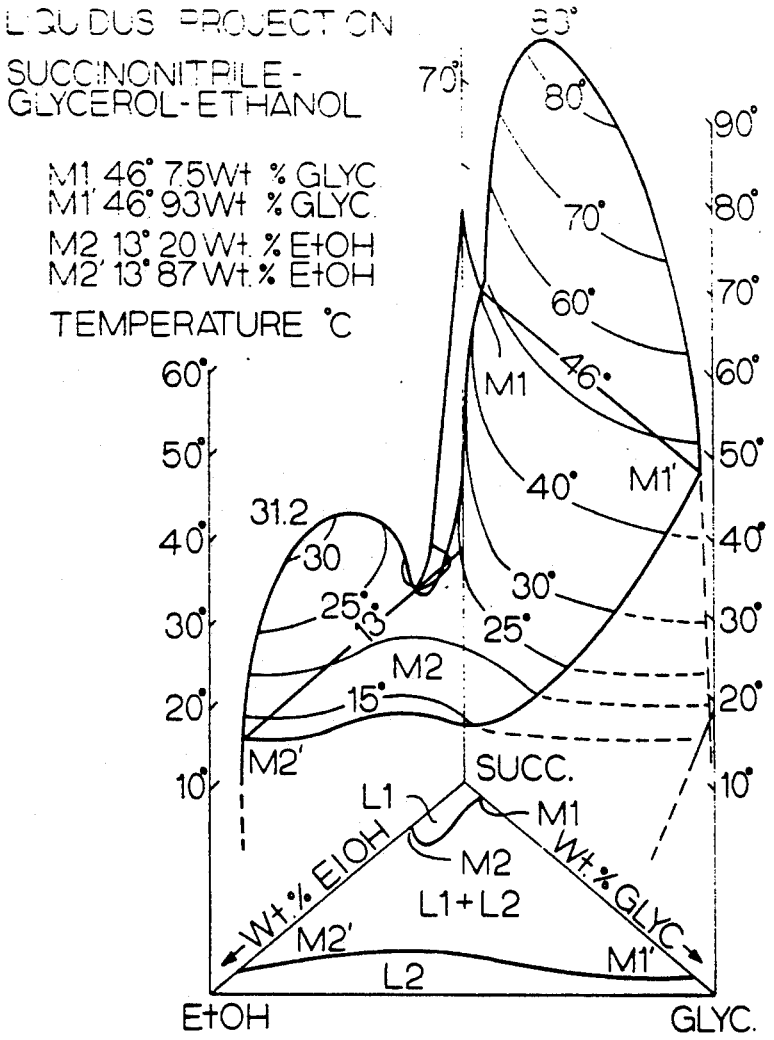
PRIOR ART FIG. 1
FIG. 1 is the succinonitrile-glycerine-ethanol phase diagram obtained from Grugel, R. N. and Hellawell, A., *Materials Research Soc. Proc.*, Elsevier Science Pub. Co., Inc. 1982, Vol. 19, pp. 417–422.

Referring to the figures, and a particular FIG. 2, there is illustrated the thin cell to form the examples set forth hereinafter in this application. The thin cell is generally designated as 20.

Thin cell 20 includes a pair of generally parallel and spaced-apart transparent plates, 22, 24, made from a material such as glass. Plates 22, 24 have opposite end surfaces 26, 28 and 30, 32, respectively. Furthermore, plates 22, 24 have opposite top ends 34, 36, respectively, and bottom 38 (the bottom edge is not illustrated for plate 24) ends, respectively.

A pair of spacers, 42, 44 are positioned adjacent ends 26 and 30 of plates 22 and 24. Another pair of spacers 46, 48 are positioned at end 28, 32 of plates 22, 24, respectively.

A plurality of fibers 50 extend between spacers 42, 44 and 46, 48 in such a fashion that they are constrained and centered within the volume defined by the plates 22, 24. The fibers do not touch the surfaces of the plates. Plates 22, 24 are sealed adjacent their bottom edges 38, 40 by an epoxy or the like.

A thermocouple 52 is positioned within the volume defined by plates 22, 24 so as to provide accurate temperature measurements.

Once the mixed hypermonotectic liquid is introduced into the thin cell 20, the thin cell is sealed by epoxy or the like adjacent the top ends 34, 36 of plates 22, 24.

Experimental Procedure

This study utilized models based on the organic succinonitrile (SCN)-glycerine (GLC) and succinonitrile-ethanol (EtOH) systems. Both systems exhibit a miscibility gap as shown in FIG. 1. The SCN-GLC system is a typical wetting system, whereas the SCN-EtOH system is nonwetting system.

Both of these systems have previously demonstrated solidification behavior analogous to metallic systems. R. N., Grugel and A. Hellawell, *Materials Research Soc. Proc.*, Elesevier Science Pub. Co., Inc., 1982, Vol. 19, pp. 417–422; R. N. Grugel, T. A. Lograsso, and A. Hellawell: *Metall.Trans.A,* 1984, Vol. 15A, pp. 1003–1012; and R. N. Grugel and A. Hellawell, *Métall. Trans. A,* 1984, Vol. 15A, pp. 1626–1631). Thus, these results have direct application to metal alloy systems.

Figure 12:
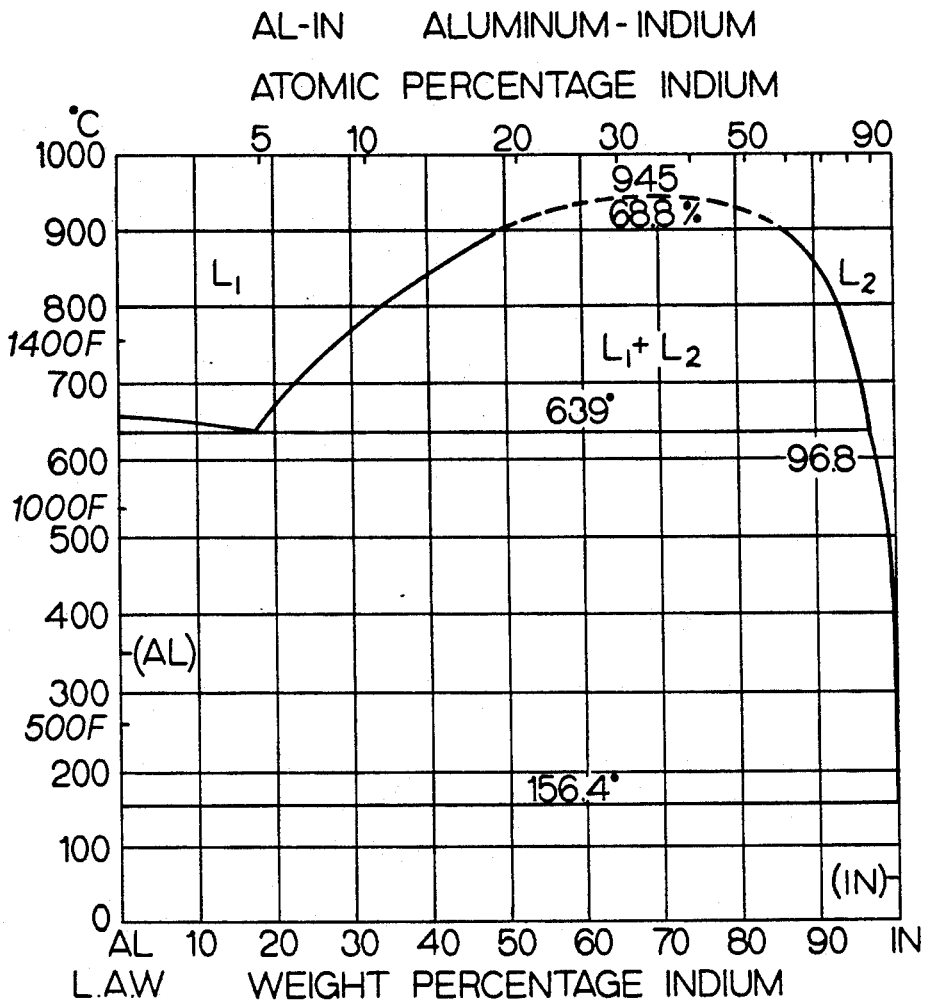
PRIOR ART FIG. 12
FIG. 12 is a binary phase diagram for the aluminum-indium alloy system.

For example, work has been done with an aluminum-indium alloy system using zirconia-reinforced alumina fibers. FIG. 12 is a binary phase diagram of the aluminum-indium alloy system.

Figure 13:
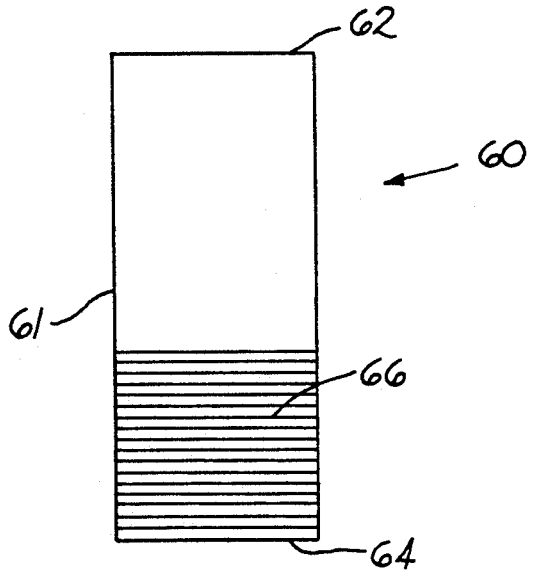
FIG. 13 is a side mechanical schematic view of the cylindrical casting apparatus used to pressure cast an aluminum-indium alloy with zirconia-reinforced alumina fibers.

FIG. 13 schematically illustrates the pressure cast apparatus, generally designated as 60. The apparatus includes a container 61 which is of a general cylindrical shape. Container 61 has opposite top 62 and bottom 64 ends. A plurality of aligned fibers 66 are positioned near the bottom end 64. In this embodiment, the fibers are zirconia-reinforced alumina fibers.

The Al-In alloy of 18 wt.pct. indium is melted and the molten liquid forced through the volume of the container where it infiltrates the fibers and solidifies about the fibers at an effective cooling rate of about 0.37 K $s^{-1}$.

Figure 14:
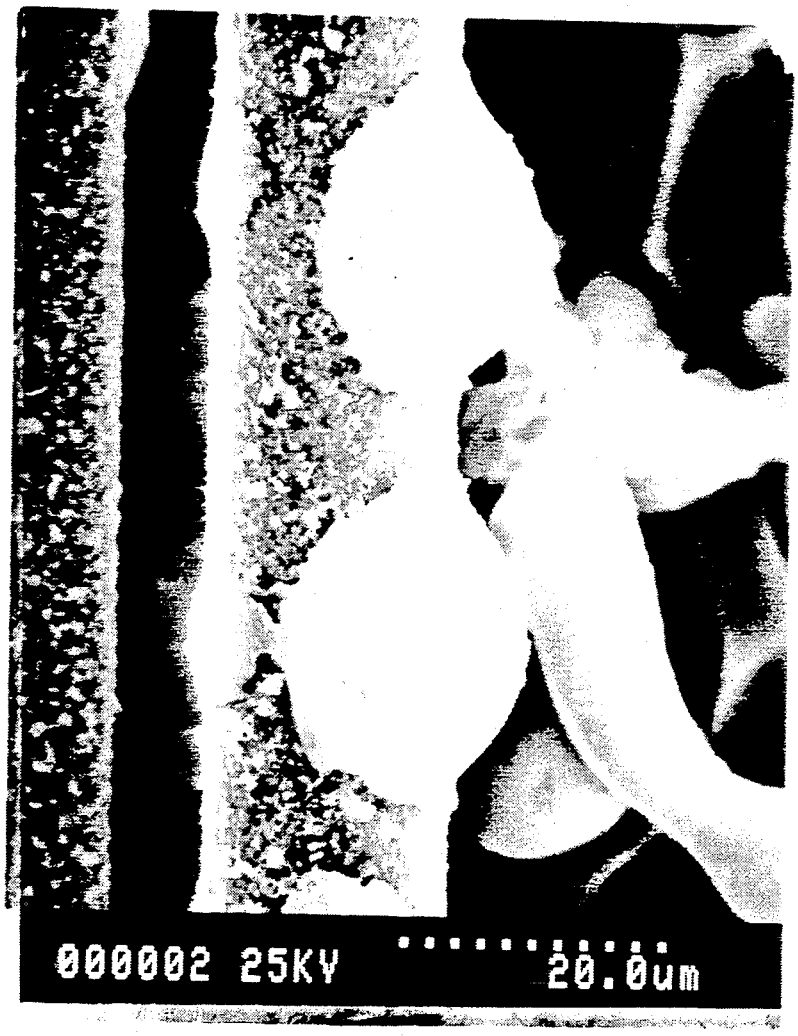
FIG. 14 is a photomicrograph of an aluminum-18 wt.pct. indium alloy system using zirconia-reinforced alumina fibers that was pressure cast wherein the aluminum was preferentially removed by a weak sodium hydroxide-water solution. The scale is shown as 20.0 $\mu m$.
Figure 15:
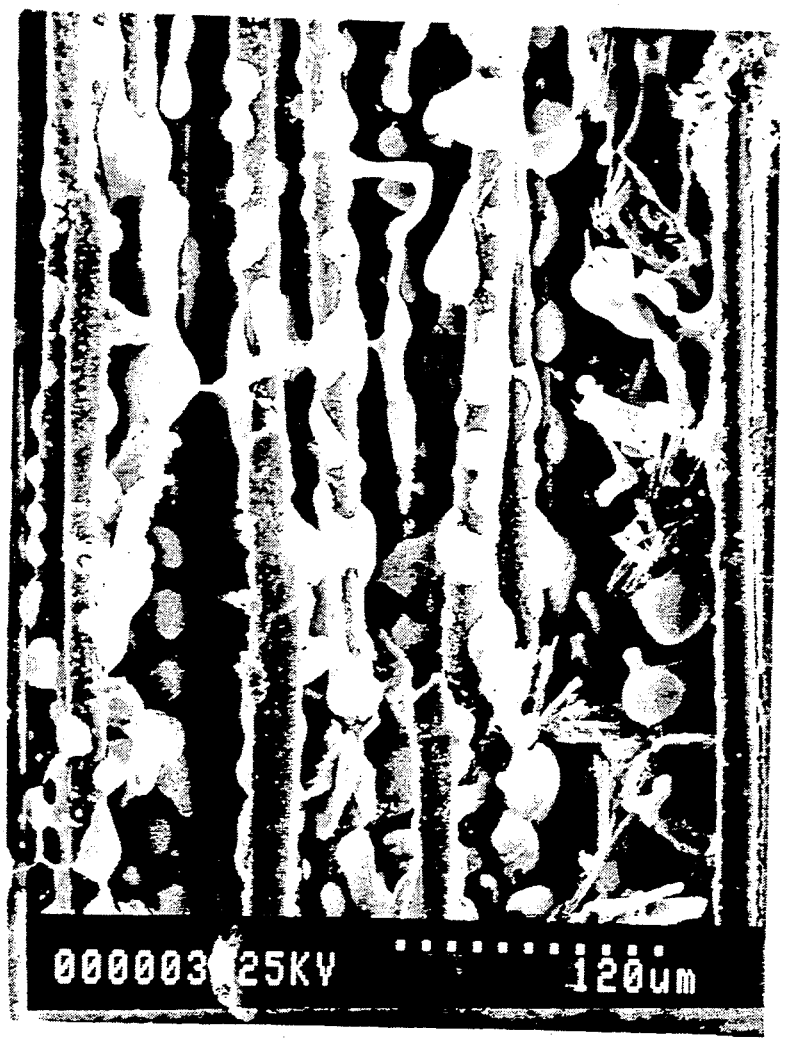
FIG. 15 is a photomicrograph of an aluminum-18 wt.pct. indium alloy system using zirconia-reinforced alumina fibers that was pressure cast wherein the aluminum was preferentially removed by a weak sodium hydroxide-water solution. The scale is shown as 120 $\mu m$.

FIGS. 14 and 15 are photomicrographs of the Al-In alloy with zirconia-reinforced alumina whiskers. To prepare the specimen, the aluminum was removed by a weak sodium hydroxide-water solution. The photomicrographs show that the indium has preferentially wet on the zirconia-reinforced aluminum fibers. Thus, the application of this invention to metal alloy systems is clearly demonstrated.

Other metal systems include the copper-barium-yttrium system for superconductors and the aluminum-lead system.

A temperature gradient stage based on the design of Hunt, et al., (J. D. Hunt, K. A. Jackson, and H. Brown: *Rev.Sci.Insts.*, 1966, Vol. 37, p. 805; J. T. Mason and M. A. Eshelman: IS-4906, UC-37, 1986, Iowa State University, Ames, IA 50011), was utilized in conjunction with thin cells filled with the hypermonotectic solution of interest. This technique allows for the direct observation of a solidification interface under controlled and repeatable conditions.

One novel feature of this invention has been the incorporation of constrained, aligned, and centered fibers internal to and along the length of the cell. This was accomplished by winding the fibers around two fine screw threads (83.5 threads $cm^{-1}$) separated by approximately 10 cm. This technique had the advantage of aligning the fibers, providing an even separation between the fibers, and maintaining a tension on the fibers.

This combination of spacing and tension ensured that the fibers would be aligned, centered and not in contact with the cell's internal surfaces of the cell. Furthermore, the fibers will not be influenced (e.g. pushed) by the advancing reaction interface. This is a factor that must be considered when fibers are used.

Concern about establishing a favorable fiber-$L_{11}$ interfacial surface energy prompted the utilization of four fiber types; namely, an enamel-coated copper, a kanthal (iron-chromium.-aluminum resistance wire), a glass Corning #7740, and Teflon®. The respective diameters of the fibers listed above are approximately 60 μm (enamel-coated copper), approximately 38 μm (kanthal), approximately 50 μm (glass) and approximately 20 μm (TEFLON®). The two spacers each had a thickness of approximately 100 μm so that the resulting cell gap varied from approximately 220 μm to 260 μm.

The solutions were prepared in a test tube suspended in a heat bath and vigorously stirred to ensure complete mixing. The liquid was then introduced into the thin cell which rapidly filled by capillary action. The cell was then sealed with epoxy.

Traction, i.e. solidification, rates from 0.1 to 6 μm $s^{-1}$ were employed, and chromel-alumel thermocouples with wire diameters of approximately 76 μm were incorporated within the cell to measure temperature gradients.

Experimental Results and Discussion

The Succinonitrile-10 wt.% Glycerine System

This system exhibits a monotectic reaction of approximately 7.5 wt.pct glycerine, see FIG. 1, and is characteristic of those in which the $L_{II}$ (glycerine) phase preferentially wets $S_I$ (succinonitrile). Examination of the phase diagram (FIG. 1) coupled with a short calculation show that for this alloy system, $L_{II}$ should begin to precipitate out of $L_I$ at approximately 55° C. and at the monotectic horizontal will occupy a volume fraction of approximately 2.4%. This volume fraction (2.4%) constitutes the excess $L_{II}$, which is to be uniformly incorporated into the matrix.

Figure 3:
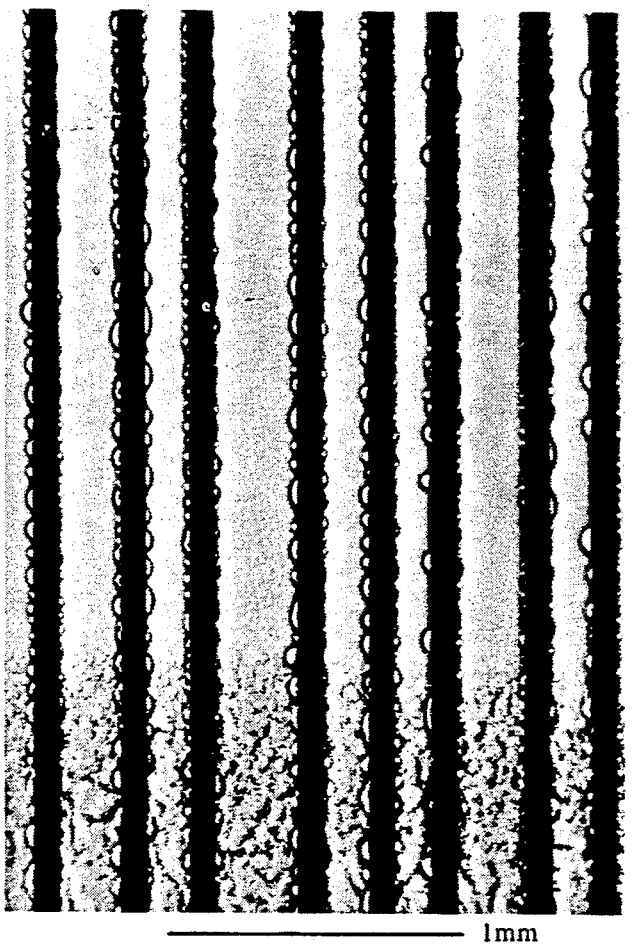
FIG. 3 is a photomicrograph of a succinonitrile-10 wt.pct glycerine composite, with a growth velocity equal to 0.6 $\mu m\ s^{-1}$, a temperature gradient equal to 45 K $cm^{-1}$, and wherein the fibers are enamel-coated copper fibers. The photomicrograph shows a scale of 1 mm.

FIG. 3 is a photomicrograph which shows this excess $L_{II}$ preferentially wetting and adhering to the enamel-coated copper fibers in the $L_I+L_{II}$ region and through the monotectic reaction. This was also the case for the Teflon® and kanthal fibers, but not for the glass fibers, which exhibited little, if any, wetting by the $L_{II}$ (glycerine) phase.

Figure 4:
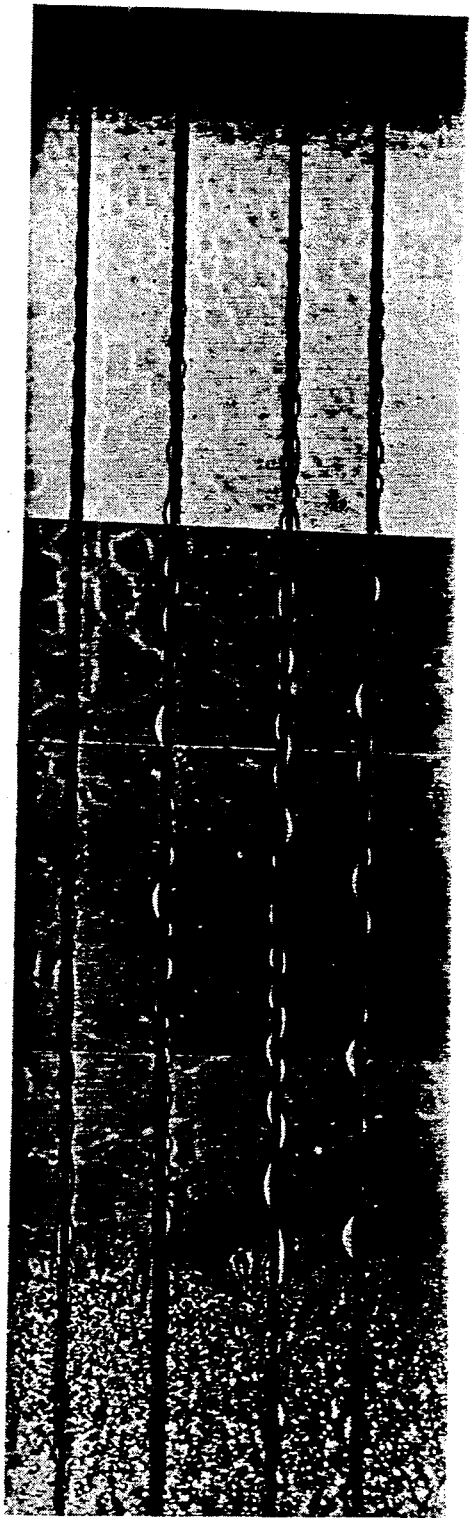
FIG. 4 is a succinonitrile-10 wt.pct glycerine composite, with a growth velocity equal to 1.0 $\mu m\ s^{-1}$, a temperature gradient equal to 39.3 K $cm^{-1}$, and wherein the fibers are TEFLON ® fibers The photomicrograph shows a scale 250 $\mu m$.

The initial wetting, coalescence, and subsequent volume fraction increase of the $L_{II}$ phase is well exemplified by the composite photomicrograph, FIG. 4. At the growth rate imposed, no significant undercoolings the $L_I-L_IL_{II}$ and $L_{II}\rightarrow S_I+L_{II}$ reactions are expected, thus dividing the temperature difference between the $L_I$—$L_IL_{II}$ boundary (approximately 55° C.) and the monotectic temperature (approximately 46° C.) by the measured temperature gradient of 39.3 K $cm^{-1}$ predicts that precipitation of $L_{II}$ should occur approximately 2.3 mm ahead of the monotectic reaction. This is in good agreement with FIG. 4, where $L_{II}$ is seen to initiate on the Teflon® fibers and quickly grow in volume fraction as the monotectic reaction is approached.

Figure 5:
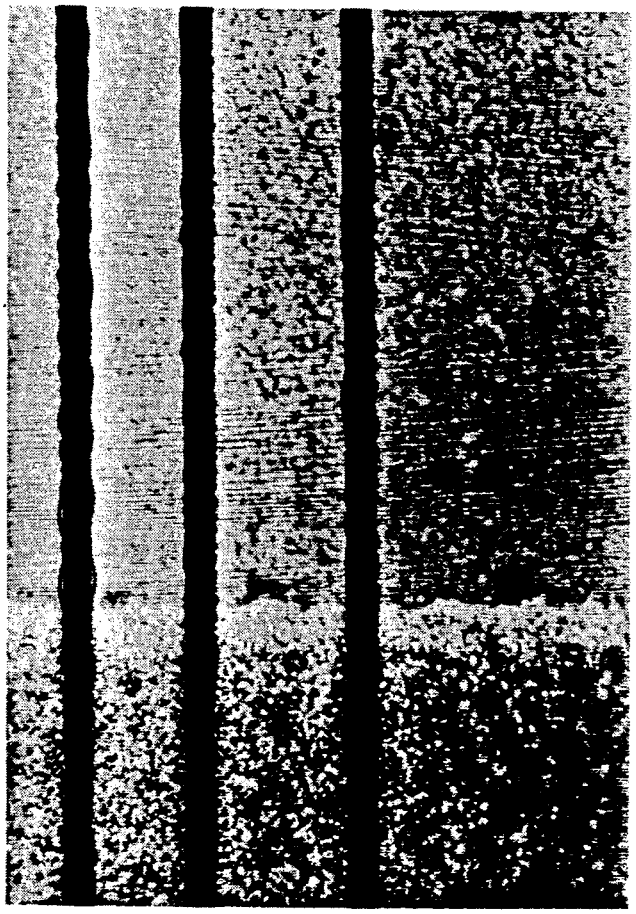
FIG. 5 is a photomicrograph of a succinonitrile-10 wt.pct glycerine composite, with a growth velocity equal to 6.0 $\mu m\ s^{-1}$, a temperature gradient equal to 42.5 K $cm^{-1}$, and wherein the fibers are enamel-coated copper fibers. The photomicrogragh shows a scale of 1 mm.

The effect of growth velocity was also investigated. The sample shown in FIG. 5 was translated at 6 μm $s^{-1}$, and when compared with FIG. 3, considerably more and finer $L_{II}$ precipitates are seen in the bulk, and consequently, less on the fibers. At this velocity, a nucleated droplet spends approximately 6.4 minutes in the $L_I L_{II}$ region as compared to a duration of 64 minutes for growth rate of 0.6 $\mu m\ s^{-1}$. Comparison of the photomicrographs, FIGS. 3 and 5, shows that the more time spent in the $L_I L_{II}$, the greater the extent of $L_{II}$ accumulation on the fibers. Although a difference in the fiber spacing is noted, qualitatively, this what one would expect, be it a diffusional process, coalescence of droplets from convection-driven collisions, or some combination of the two.

It is well known that uniform composites can be directionally solidified from off-eutectic compositions at sufficiently low growth velocities and/or high temperature gradients (F. R. Molland and M. C. Flemmings, *Trans. TMS-AIME,* 1967, 239, pp. 1526–1583; and M. H. Burden and J. D. Hunt, *J. Cryst. Growth,* 1974, Vol. 22, pp. 3280330). Low growth rates were investigated keeping in mind the practicability of the above analysis to a condition where excess $L_{II}$ must be incorporated. Whereas sheet→rod structures have been shown in off eutectic growth, the $L_{II}$ volume increase may necessitate liquid rods→liquid sheets—a rather improbable consideration. Furthermore, it is the inherent nature of these systems to decompose spinodally.

Figure 6A:
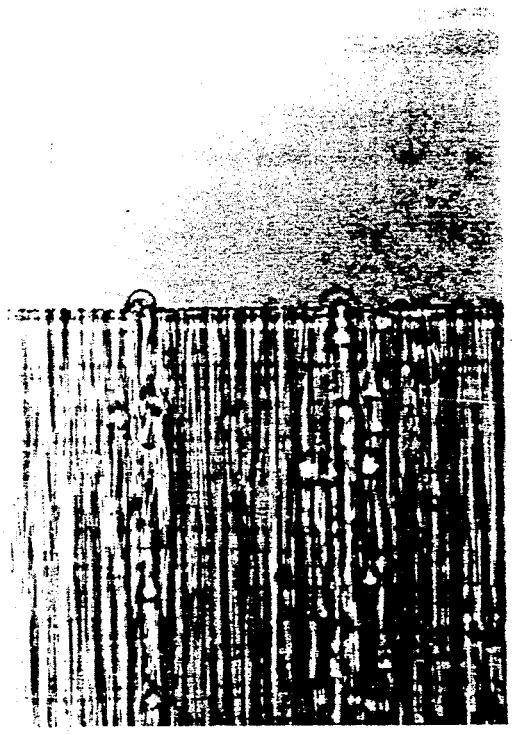
FIG. 6A is a photomicrograph of an succinonitrile-10 wt.pct glycerine composite, with a growth velocity equal to 0.1 $\mu m\ s^{-1}$, a temperature gradient equal to 55.5 K $cm^{-1}$, and wherein there are no fibers. The photomicrograph shows a scale of 250 $\mu m$.
Figure 6B:
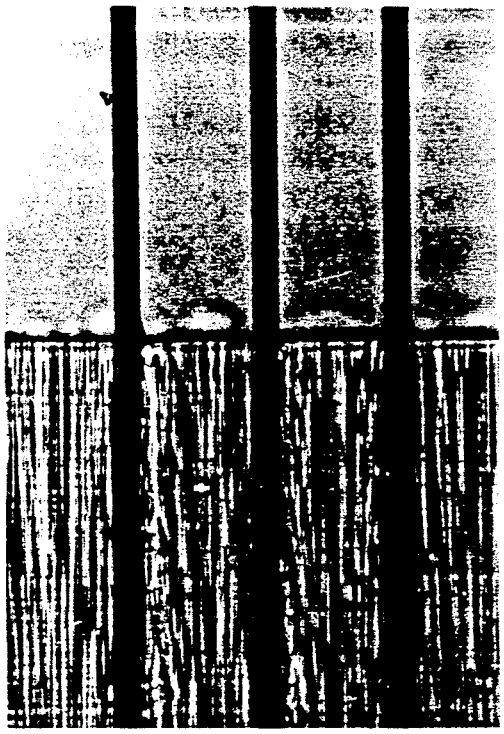
FIG. 6B is a photomicrograph of an succinonitrile-10 wt.pct. glycerine composite, with a growth velocity equal to 0.1 $\mu m\ s^{-1}$, a temperature gradient equal to 55.5 K cm1, and where the fibers are kanthal fibers. The photomicroograph shows a scale of 250 $\mu m$.

In view of FIGS. 6A and 6B (with kanthal fibers) it appears initially that suppression of $L_{II}$ is possible, a planer interface can be maintained and some degree of aligned, uniform composite growth achieved. There is one difference. Excess $L_{II}$ droplets are seen at the interface in FIG. 6A that are then rather indiscriminately incorporated. Such droplets have also been observed at the boundaries between monotectic grains.

In FIG. 6B, the excess $L_{II}$ is associated with the kanthal fibers, although some droplet incorporation between fibers was also seen. Unlike metal alloys, it is not practical to examine these samples in cross-section and hence ascertain the actual distribution of the $S_I$ and $S_{II}$ phases. Although apparently suppressed, it cannot be verified whether the excess $L_{II}$ phase is actually incorporated or is simply and conveniently wetting the inside glass surfaces of the cells, as is implied by the diffuse "halos" seen at the reaction interface of FIGS. 6A and 6B.

Figure 7A:
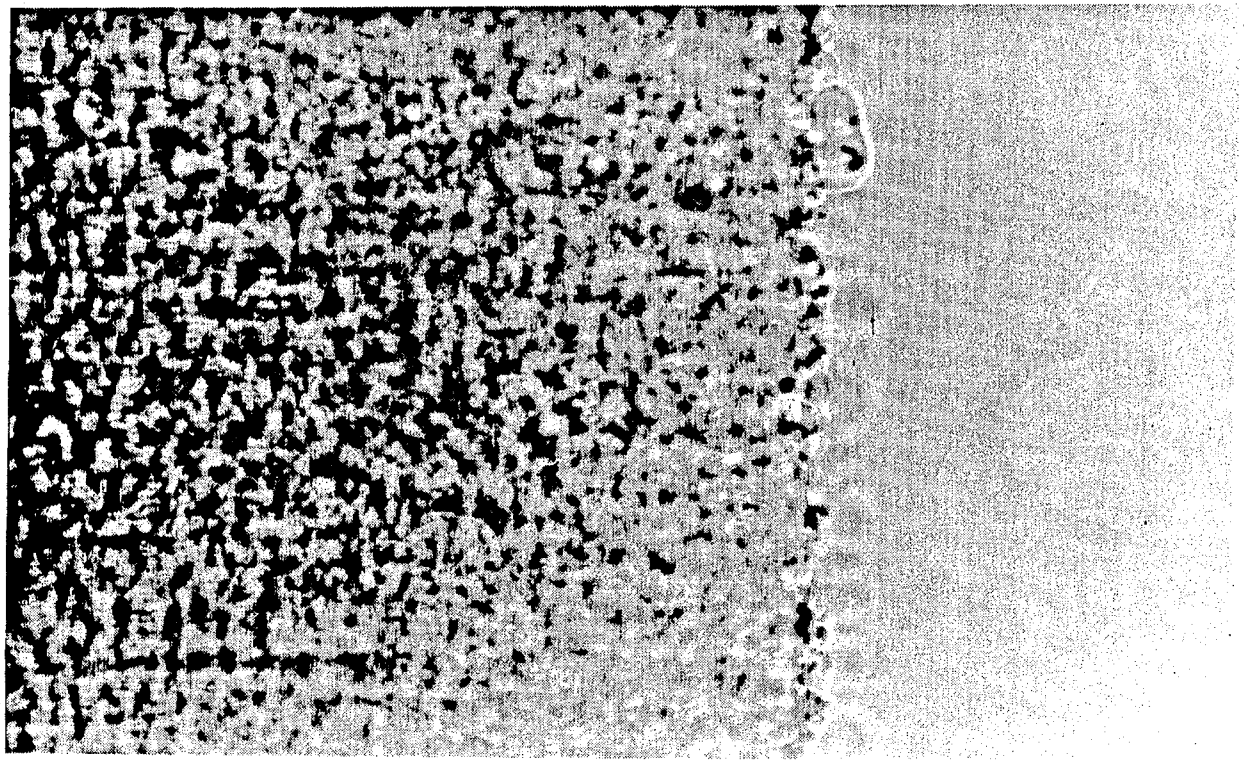
FIG. 7A is a photomicrograph of an succinonitrile-10 wt.pct glycerine composite, with a growth velocity equal to 0.2 $\mu m\ s^{-1}$, a temperature gradient equal to 55.5 K $cm^{-1}$, and, where there are no fibers.
Figure 7B:
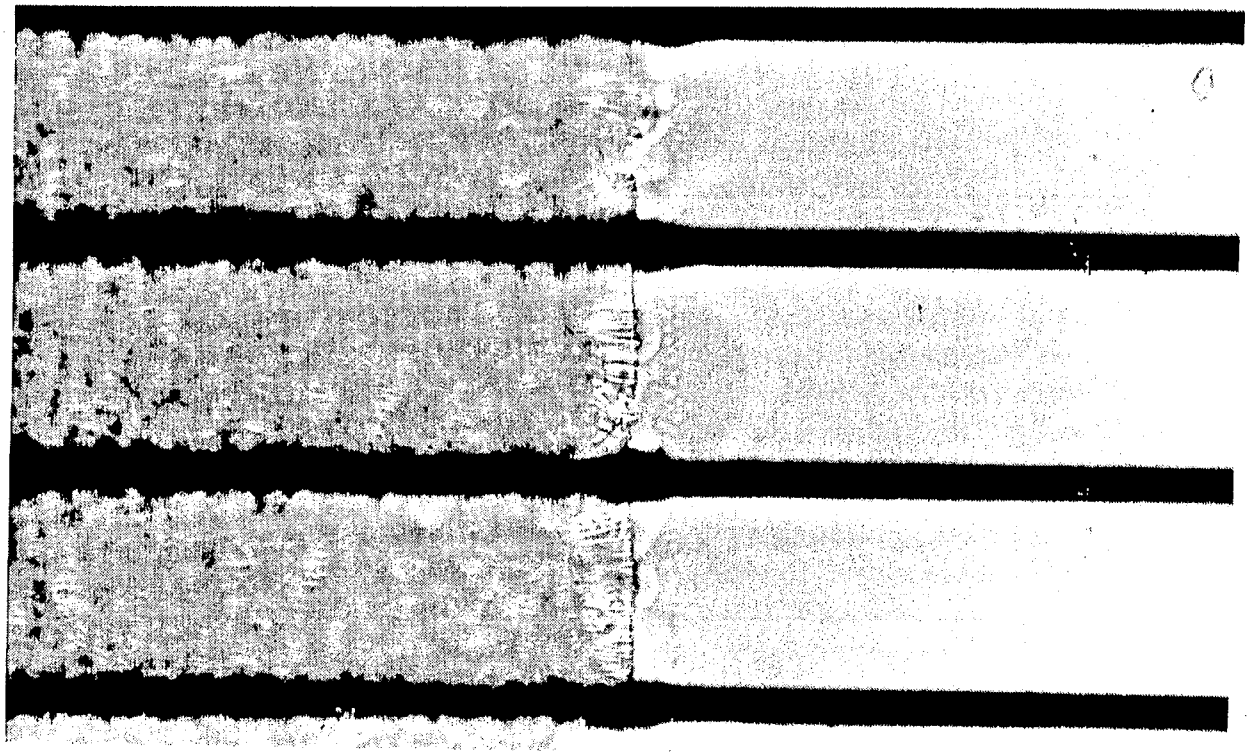
FIG. 7B is a photomicrograph of an succinonitrole-10 wt.pct. glycerine composite, with a growth velocity equal to 0.2 $\mu m\ s^{-1}$, a temperature gradient equal to 55.5 K cm1, and wherein the fibers are kanthal fibers.

In an attempt to shed some light on this question, and recalling the microstructure at a growth velocity of 0.6 $\mu m\ s^{-1}$. (FIG. 3), the growth rate was increased from 0.1 to 0.2 $\mu m\ s^{-1}$. FIGS. 7A and 7B should be compared with the previous set, FIGS. 6A and 6B, noting first that accumulation of $L_{II}$ ahead of the interface is now much more evident with the increased growth rate. The interface of the fiberless region, FIG. 7A, appears irregular, and there is little, if any, indication of directional composite growth. However, in FIG. 7B, the apparent broadening of the fibers just ahead of the reaction interface suggests accumulation of $L_{II}$, with the interfiber regions still being relatively planar and exhibiting reasonably well aligned composite growth.

Applicant submits that with the excess $L_{II}$ accumulating at the fibers, the local composition of the interfiber liquid approaches that of the monotectic reaction (approximately 7.5 wt.% glycerine), thus facilitating uniform composite growth. In the fiberless region, the excess $L_{II}$ only contributes to disrupting the interface as it either wets $S_I$ or coalesces with the $L_{II}$ reaction product. The initial question of whether the $L_I - L_{II}$ reaction was suppressed or if the excess $L_{II}$ can simply be accounted for by preferential surface wetting of the cell is unanswered as its final distribution is unknown. However, the above observations suggest that the included fibers account for the excess $L_{II}$, which consequently promotes uniform, aligned composite growth in the regions between the fibers. The advantages of using fibers is clearly seen and demonstrated by these results.

The Succinonitrile-26 wt% of Ethanol System

This system exhibits a monotectic reaction at approximately 20.2 wt.pct ethanol (A. Ecker et al., *Metall. Trans. A,* 1989, Vol. 20A, pp. 2517–2527 and is characteristic of those in which the $L_{II}$ phase (ethanol) does not preferentially wet $S_I$ (succinonitrile). Precipitation of $L_{II}$ should begin at approximately 17° C. (A. Ecker et al., *Metall. Trans. A,* 1989, Vol. 20A, pp. 2517–2527) and at the monotectic horizontal occupy a volume fraction of approximately 11.4%, which is considerably more than the volume fraction (2.4%) of the SCN-10 wt.% GLC alloy.

Figure 8A:
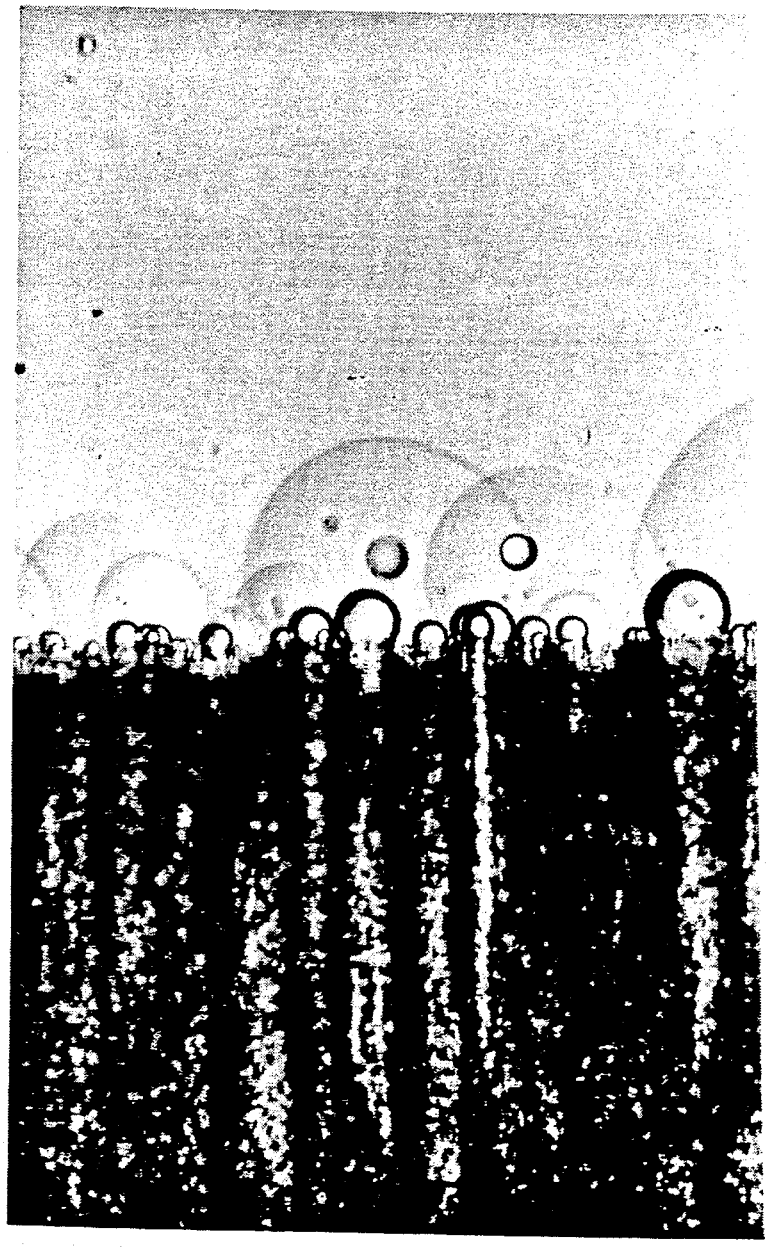
FIG. 8A is a photomicrograph of an succinonitrile-26 wt.pct ethanol composite, with a growth velocity equal to 0.6 $\mu m\ s^{-1}$, a temperature gradient equal to 30.1 K $cm^{-1}$, and where there are no fibers.
Figure 8B:
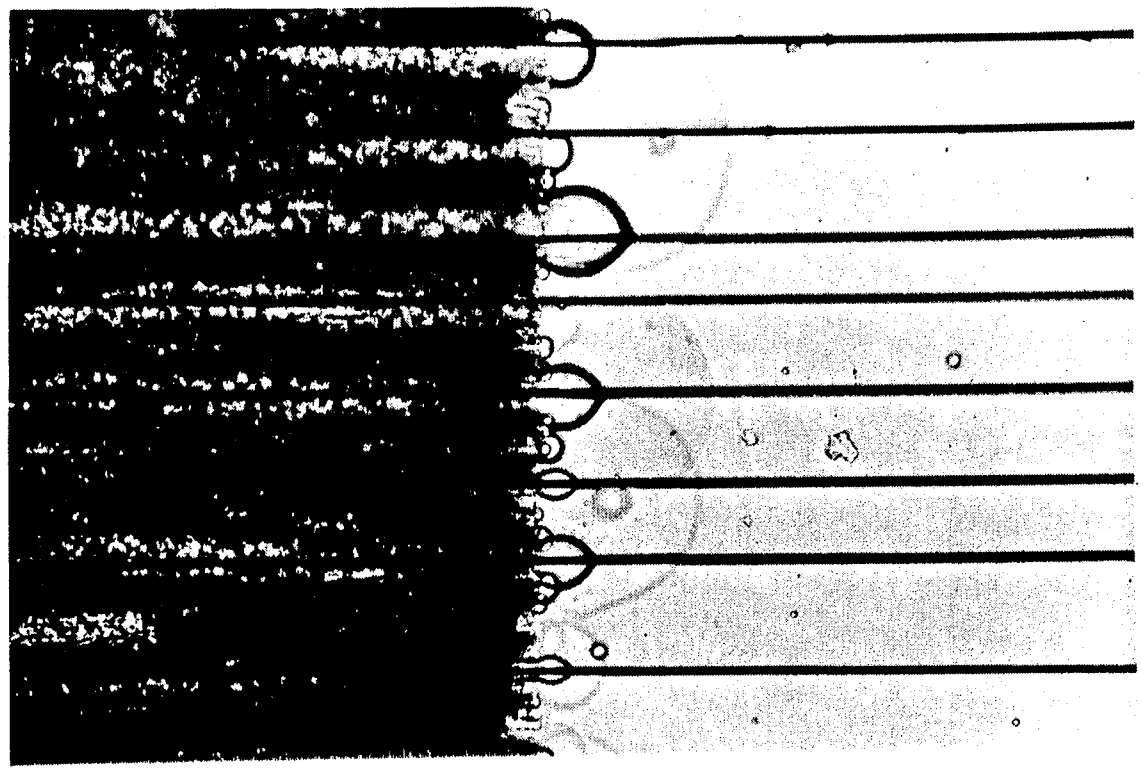
FIGS. 8B is a photomicrograph of an succinonitrile-26 wt.pct ethanol composite, with a growth velocity equal to 0.6 $\mu m\ s^{-1}$, a temperature gradient equal to 30.1 K $cm^{-1}$, and wherein the fibers are TEFLON ® fibers.
Figure 9:
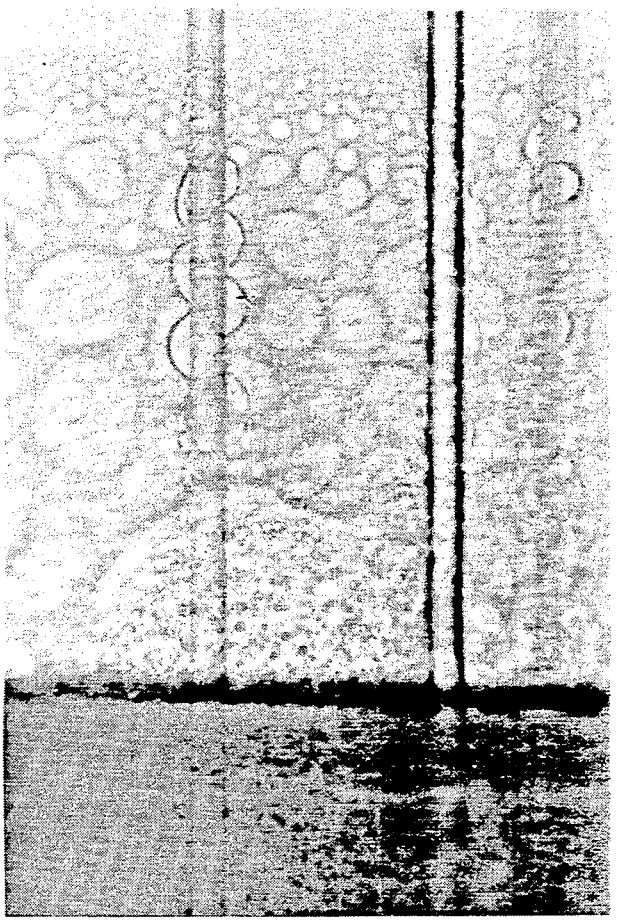
FIG. 9 is a photomicrograph of an succinonitrile-26 wt.pct ethanol composite, with a growth velocity equal to 0.6 $\mu m\ s^{-1}$, a temperature gradient equal to 54.6 K $cm^{-1}$, and wherein the fibers are glass fibers. The photomicrograph shows a scale of 250 $\mu m$.

Fiber-$L_{II}$ interactions also developed in this system as shown in FIGS. 8A and 9. Excess $L_{II}$ is seen to wet the glass surface. Here, drops such as those slightly ahead of the interface in FIG. 8A were observed to contact the glass and spread, adding to an existing halo or creating a new one. Being continually replenished at the interface, $L_{II}$ is directionally, though irregularly, incorporated and when compared, the microstructures seen in FIGS. 8A and 8B are essentially the same. The fibers, however, do accrue the excess $L_{II}$ and serve as guides to insure uniform and aligned incorporation. Cross-sectional views of the microstructure are necessary to truely ascertain the final phase distributions.

Figure 10B:
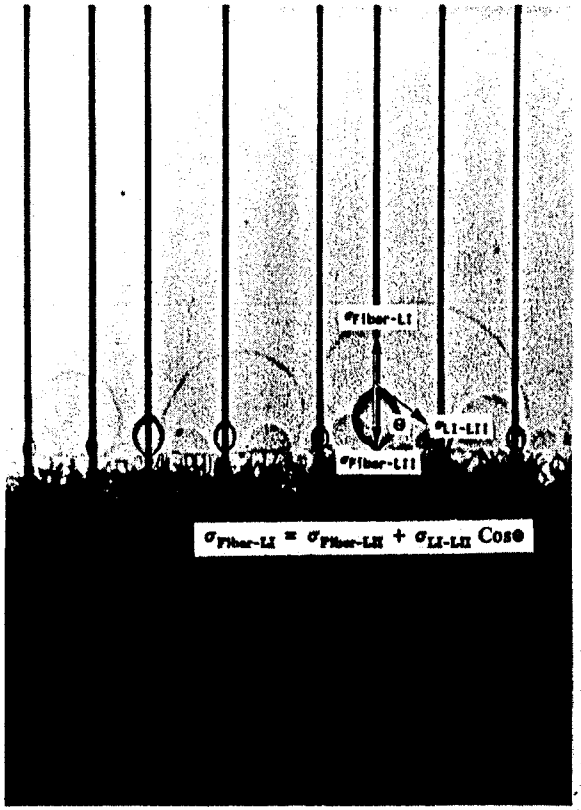
FIG. 10B is a photomicrograph of an succinonitrile-26 wt.pct ethanol composite, with a growth velocity equal to 6.0 $\mu m\ s^{-1}$, a temperature gradient equal to 27.8 K $cm^{-1}$, and wherein the fibers are kanthol fibers. A schematic representation of the relative surface energy phase relationships has been superimposed on this photomicrograph. This photomicrograph shows a scale of 1 mm.
Figure 10A:
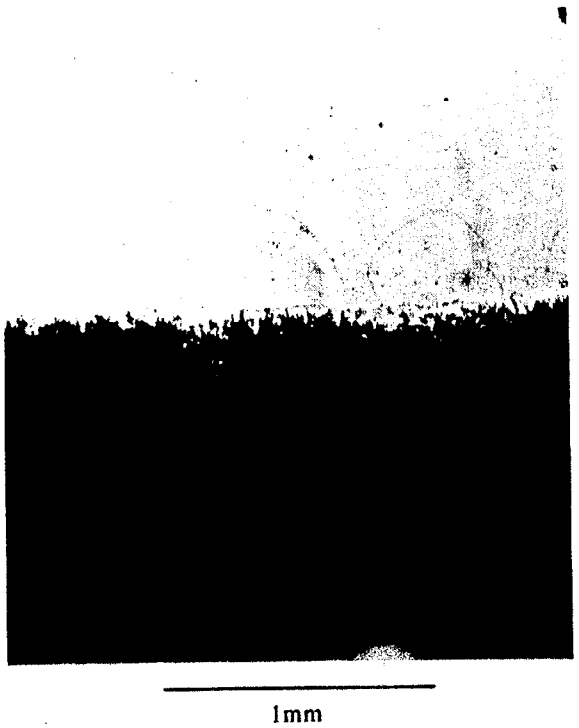
FIG. 10A is a photomicrograph of an succinonitrile-26 wt.pct ethanol composite, with a growth velocity equal to 6.0 $\mu m\ s^{-1}$, a temperature gradient equal to 27.8 K $cm^{-1}$ and where there are no fibers. The photomicrograph shows a scale of 1 mm.

FIGS. 10A and 10B show the microstructure at a growth rate of 6 $\mu m\ s^{-1}$. At this rate the fibers appear to play a role in holding and incorporating the excess $L_{II}$; incorporation of excess $L_{II}$, if any, is not apparent in FIG. 10A.

Figure 11A:
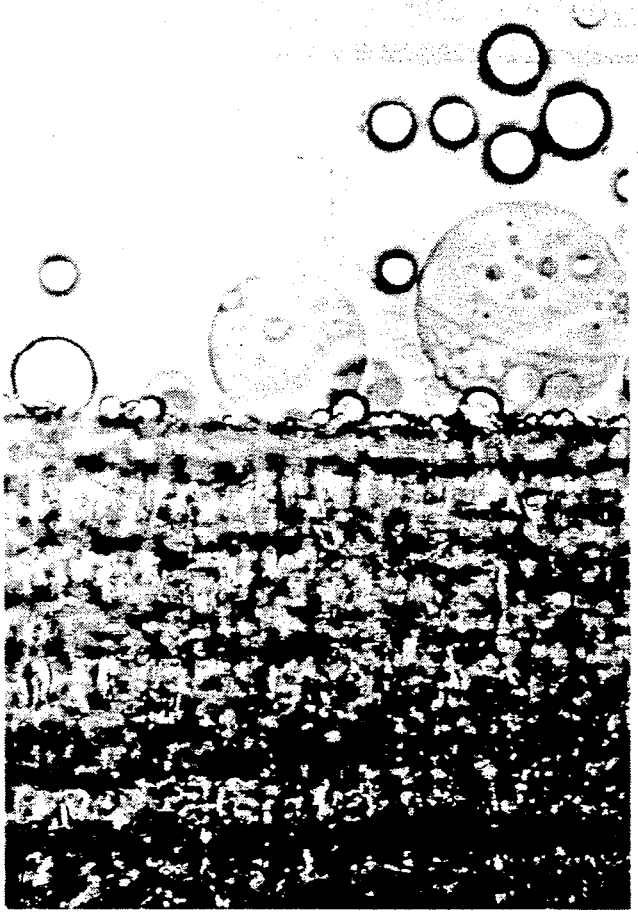
FIG. 11A is a photomicrograph of an succinonitrile-26 wt.pct glycerine composite, with a growth velocity equal to 0.1 $\mu m\ s^{-1}$, a temperature gradient equal to $^{-30}$K $cm^{-1}$, and where there are no fibers. The photomicrograph shows a scale of 250 $\mu m$.
Figure 11B:
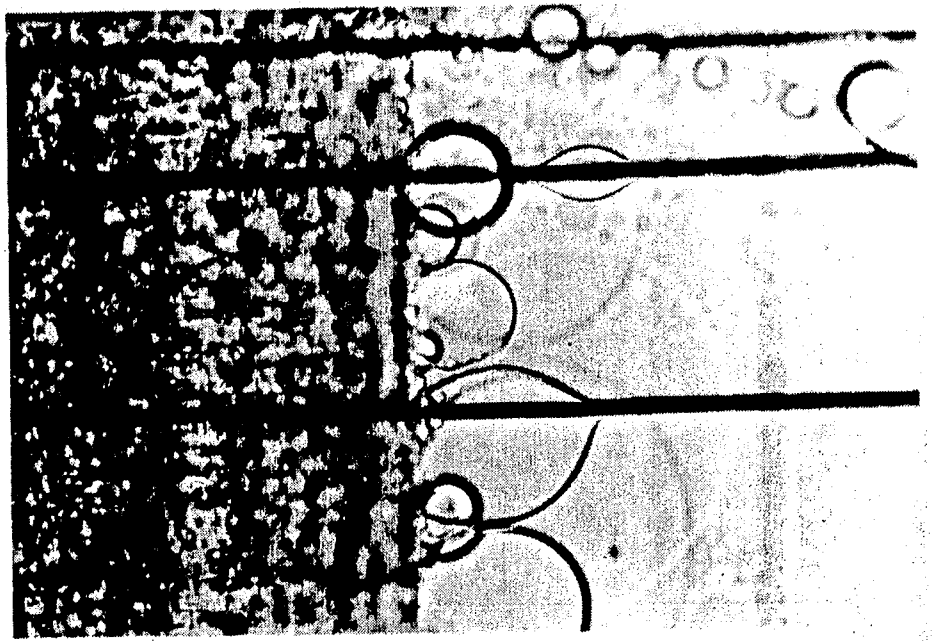
FIG. 11B is a photomicrograph of an succinonitrile-26 wt.pct glycerine composite, with a growth velocity equal to 0.1 um $s^{-1}$, a temperature gradient equal to $^{-30}$K $cm^{-1}$, and wherein the fibers are kanthal fibers.

FIGS. 11A and 11B show the microstructure at a growth rate of 0.1 $\mu m\ s^{-1}$. The microstructure is not obviously improved in comparison to the faster growth rates, and excess $L_{II}$ is still seen ahead of the interface. The results, however, do suggest using fibers as guides to ensure incorporation and alignment of the excess $L_{II}$, which, given the irregular growth of these "non-wetting" systems, may prove more useful in aligning the $L_{II}$ phase in alloys of monotectic composition.

In addition to aligning and incorporating the excess $L_{II}$, the experimental procedure further provides a means of determining the relative surface energy between the substrate (fiber) and wetting liquid ($L_{II}$). This is schematically depicted on FIG. 10B and is expressed by the following relationship:

$$\sigma_{Fiber-LI} = \sigma_{Fiber-LII} + \sigma_{LI-LII} \cos\theta$$

Depending on the experimental arrangement, the contact angle, $\theta$, can be measured isothermally or as a function of temperature as dictated by the imposed gradient.

Experimental Considerations

The addition of constrained and aligned fibers adds a new dimension to the solidification of hypermonotectic alloys. The viability of this process has been clearly demonstrated. As previously stressed, the inability to examine the microstructure in cross-section precludes any complete description of the phase distributions. The wetting of $L_{II}$ which is seen on the internal surfaces of the cell also warrants some comments.

Figure 2A:
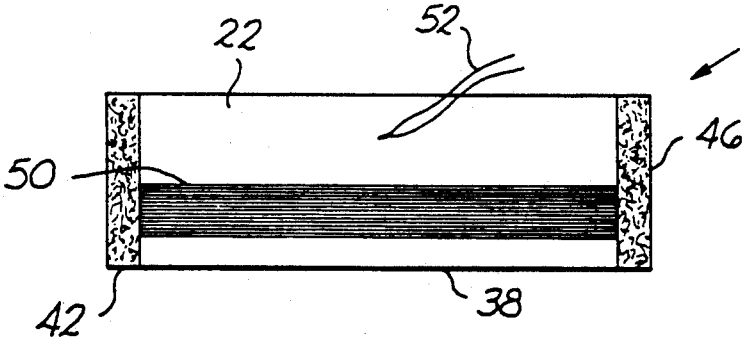
FIG. 2A is a side schematic drawing of the thin cells used to perform the organic system examples recited in this application.
Figure 2B:
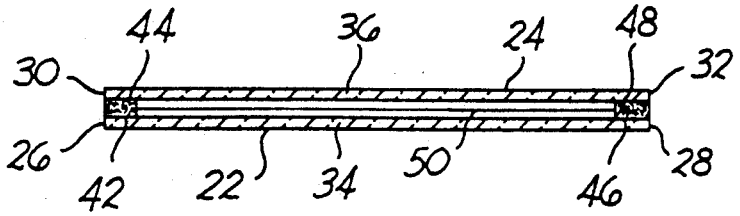
FIG. 2B is a top schematic drawing of the thin cell of FIG. 2A.

First of all, the thin cell configuration, FIG. 2, does not give a favorable fiber surface area to glass cell surface area ratio. Such a ratio would be greatly improved by incorporating many fibers internal and along the length of a cylindrical sample tube such as might be used in the directional solidification studies of metals. Furthermore, for an optimum situation, one should consider the number of fibers, their diameter, and their center-to-center displacement for a given volume of excess $L_{II}$.

Secondly, there is the issue of whether $S_I$ or $L_I$ wets the glass. Previous attempts to alter the wetting characteristics of these systems by vapor depositing graphite or gold onto the surface prior to fabrication of the cell resulted in no microstructural changes. Recently, a silicon oil treatment of the glass surface (D. O. Frazier, B. R. Facemire, and U. S. Fanning, *Acta Metall.*, 1986, Vol. 34, No. 1, pp. 63–72) was shown to effect a change in the wetting behavior of succinonitrile in a near-monotectic SCN-ethanol mixture (D. O. Frazier, B. R. Facemire, B. H. Loo, D. Burns, and D. B. Thiessen, J. *Cryst Growth*, 1990 Vol. 106, pp. 101–115). This, however, does nothing to promote the uniform inclusion of any excess $L_{II}$ which must then simply coalesce internally as was seen in a microgravity experiment (C. Potard, *J. Brit. Interplanetary Soc.*, Vol. 31, 1978, pp. 543–551) and a ground-based study (H. C. de Groh, III and H. B. Probst, NASA TM-101372, 1988).

Thus, regardless of the wetting conditions, massive segregation of the $L_{II}$ phase is imminent unless accounted for in some manner as demonstrated in this study. This invention does account for the excess $L_{II}$. This demonstrates all the more the utility of a great advantages provided by the present invention.

This process requires the inclusion of fibers. Primarily they would be utilized to assure a uniform distribution of the excess $L_{II}$ phase. However, for instance, the fibers could be brittle, reactive, or conducting and need to be shielded by a softer or protective phase in conjunction with the matrix. It should also be noted that novel microstructures could be obtained by incorporating fibers of different sizes and/or compositions.

Another aspect to consider is post-solidification selective removal of the fiber or other phase. (L. M. Angers, R. N. Grugel, A. Hellawell, and C. W. Draper: *Proc. Conf. In-Situ Composites IV*, Elsevier Science Pub. Co., Inc., 1982, p. 205).

One might also use this technique as a processing step in the fabrication of superconductors whose phase diagram exhibits a miscibility gap. (G. J. Yurek, J. B. VanderSande, D. A. Rudman, and Y. M. Chiang: *J. of Metals*, Jan. 1988, pp. 16–18).

It is generally acknowledged that the microstructure of directionally solidified samples is some function of composition, growth velocity and temperature gradient. (M. C. Flemings, *Solidification Processing*, McGraw-Hill, N.Y., 1974; M. McLean, *Directionally Solidified Materials for High Temperature Service*, Book 296, The Metals Society, J. W. Arrowsmith Ltd., 1983; and W. Kurz and D. J. Fisher, *Fundamentals of Solidification, Trans. Tech. Publications*, 4711 Aedermannsdorf, Switzerland, 1984). Recently gravity, or lack of it, has taken enhanced status as a processing variable.

The thin cell configuration and similar densities of the components used in these experiments begin to approach the conditions one might expect in a microgravity environment and serve to minimize convective effects (R. N. Grugel and Y. Zhou, *Metall. Trans. A*, 1989, Vol. 20A, pp. 969–973) which could otherwise lead to macrosegregation.

If this technique was applied to a hypermonotectic alloy of a metallic system, e.g., Al-Pb, and with suitable fibers, perhaps alumina, it seems reasonable to expect results similar to FIG. 4. However, while surface tension would keep the excess Pb on the fibers, there is still a considerable density difference between Al and Pb. Thus, the Pb phase could be prone to running down the fiber, collecting at the interface, and resulting in severe macrosegregation.

Similarly, with regard to the wetting angle measurements, it is reasonable to expect that in unit-gravity the shape of the $L_{II}$ (FIG. 10B) phase will be distorted from it's equilibrium value. Consequently, this will lead to difficult or inexact measurements of $\theta$. The above mentioned concerns might be minimized by solidifying at some orientation to the earth's gravity vector; however, they would be essentially eliminated in a microgravity environment.

Throughout this application, mention has been made of directional solidification. It should be mentioned that other cooling techniques are within the scope of the invention. For example, a controlled cool down procedure, or a controlled cool down and isothermal holding procedure, should generally equate to the directional solidification technique as far as the invention is concerned.

What is claimed is:

1. A uniformly aligned composite produced by the process comprising the steps of:

providing a cell having a plurality of generally parallel fibers contained therein;

mixing together two liquids of different compositions wherein the liquids have different densities and composition and wherein the system of the two liquids exhibits a miscibility gap, one of said liquids preferentially wetting the fibers over the other one of the liquids;

placing the liquid mixture within the cell; and providing a temperature gradient for the cell for directional solidification so that for a hypermonotectic composition of the liquid mixture, which presents the reaction $L_I \rightarrow S_I + L_{II}$, the $L_{II}$ will precipitate out of the $L_I$ so as to preferentially wet and coalesce along the fibers as the mixture translates to a lower temperature.

2. The product of claim 1 further including the step of:

solidifying $L_{II}$ to $S_{II}$.

3. The product of claim 1 wherein $L_{II}$ wets $S_I$.

4. The product of claim 1 wherein $L_{II}$ does not wet $S_I$.

5. The product of claim 1 wherein the liquids comprises succinotrile (SCN) and ethanol (EtOH).

6. A composite having uniformly aligned regions therein wherein the composite is formed from a system having a miscibility gap from a hypermonotectic composition and which presents the reaction $L_I \rightarrow S_I + L_{II}$ upon initial cooling and then the reaction $L_I \rightarrow S_I + L_{II}$ and the reaction $L_{II} \rightarrow S_{II}$ upon further cooling, the composite comprising:

a matrix comprised of $S_I$;

a plurality of generally parallel fibers wherein the $L_{II}$ preferentially were the fibers; and a relatively uniform thickness of $S_{II}$ on the fibers.

7. The composite of claim 6 wherein there is aligned composite growth between the fibers.

8. A uniformly aligned composite produced by the precess comprising the steps of:

providing a cell having a plurality of generally parallel zirconia-reinforced alumina fibers contained therein;

mixing together liquids of aluminum and indium;

placing the liquid mixture of aluminum and indium within the cell; and providing a temperature gradient for the cell for directional solidification so that for a hypermonotectic composition of the liquid mixture, which presents the reaction $L^{I} \rightarrow S_{I} + L_{II}$, the $L_{II}$ will precipitate out of the $L_{I}$ and coalesce along the fibers as the mixture translates to a lower temperature.

9. A uniformly aligned composite produced by the process comprising the steps of:

providing a cell having a plurality of generally parallel fibers contained therein;

mixing together succinotrile (SCN) and glycerine (GLC) to form a system that has a miscibility gap;

placing the liquid mixture within the cell; and providing a temperature gradient of the cell for directional solidification so that for a hypermonotectic composition of the liquid mixture, which presents the reaction $L_{I} \rightarrow S_{I} + L_{II}$, the $L_{II}$ will precipitate out of the $L_{I}$ so as to preferentially wet the fibers and coalesce along the fibers as the mixture translates to a lower temperature.

10. The product of claim 9 wherein the fiber comprises enamel-coated copper.

11. The product of claim 9 wherein the fiber comprises an iron-chromium-aluminum resistance wire.

12. The product of claim 9 wherein the fiber comprises polytetrafluoroethylene.

13. A uniformly aligned composite produced by the process comprising the steps of:

providing a cell having a plurality of generally parallel fibers contained therein;

mixing together succinotrile (SCN) and ethanol (EtOH) to form a system that has a miscibility gap;

placing the liquid mixture within the cell; and providing a temperature gradient of the cell for directional solidification so that for a hypermonotectic composition of the liquid mixture, which presents the reaction $L_{I} \rightarrow S_{I} + L_{II}$, the $L_{II}$ will precipitate out of the $L_{I}$ so as to preferentially wet the fibers and coalesce along the fibers as the mixture translate to a lower temperature.

14. The product of claim 13 wherein the fiber comprises enamel-coated copper.

15. The product of claim 13 wherein the fiber comprises an iron-chromium-aluminum resistance wire.

16. The product of claim 13 wherein the fiber comprises polytetrafluoroethylene.

* * * * *